US006431513B1

(12) United States Patent
Rosen

(10) Patent No.: US 6,431,513 B1
(45) Date of Patent: Aug. 13, 2002

(54) MAGNETIC SELF-STICK PAD

(76) Inventor: Howard Rosen, 2759 Casiano Rd., Los Angeles, CA (US) 90077

( * ) Notice: Subject to any disclaimer, the term of this patent is extended or adjusted under 35 U.S.C. 154(b) by 0 days.

(21) Appl. No.: 09/660,473

(22) Filed: Sep. 12, 2000

(51) Int. Cl.[7] ..... A47G 1/17
(52) U.S. Cl. ..... 248/309.4; 40/600
(58) Field of Search ..... 248/683, 205.3, 248/205.4, 205.2, 206.5, 442.2, 309.4; 40/600, 594, 621

(56) References Cited

U.S. PATENT DOCUMENTS

| | | | | | |
|---|---|---|---|---|---|
| 4,427,960 | A | | 1/1984 | Wuerfel | |
| 4,605,292 | A | * | 8/1986 | Mcintosh | 350/641 |
| 4,830,321 | A | | 5/1989 | Irie | |
| 4,964,830 | A | | 10/1990 | Wagner | |
| 5,069,339 | A | | 12/1991 | Hsu | |
| 5,179,756 | A | * | 1/1993 | Korsen | 15/246 |
| 5,249,336 | A | | 10/1993 | Miller | |
| 5,433,980 | A | * | 7/1995 | Auld et al. | 428/13 |
| 5,538,132 | A | * | 7/1996 | Propp et al. | 206/365 |
| 5,548,904 | A | | 8/1996 | Rood | |
| 5,680,709 | A | | 10/1997 | Stone | |
| 5,699,956 | A | * | 12/1997 | Brennan | 229/92.8 |
| 5,903,869 | A | * | 5/1999 | Jacobson et al. | 704/272 |
| 5,918,400 | A | | 7/1999 | Schonberger | |
| 5,983,537 | A | | 11/1999 | Johnson | |
| 5,992,807 | A | * | 11/1999 | Tarulli | 248/206.5 |
| 6,170,088 | B1 | * | 1/2001 | Tate | 2/209.13 |

OTHER PUBLICATIONS

Miller's Office Products Catalog, p. 483, item H, printed in 1998.*

* cited by examiner

*Primary Examiner*—Ramon O. Ramirez
*Assistant Examiner*—Kofi Schulterbrandt
(74) *Attorney, Agent, or Firm*—Michael I. Kroll

(57) ABSTRACT

The present invention 10 discloses an apparatus for organizing magnetic objects such as paper clips 14 and needles accessible within a workstation area 20 without being within the motor path of the work being performed, such as sewing machine needles being magnetically held to an accessible portion of a sewing machine 22 without being within the normal path of hand 28 movement. The apparatus is comprised of a pliable planar magnetic layer 32 having an optional top adhesive layer and bottom adhesive layers 26 whereby the magnetic apparatus can be selectively positioned or repositioned on any vertical, horizontal or curved magnetic and/or non-magnetic surface 12. A protective element 24 or hook and loop material covers the bottom adhesive layer 26 and a top layer 30 may be provided having an indicia 18 thereon, such as the company logo. A raised border 34 may also be provided around the periphery of the present invention 10.

4 Claims, 12 Drawing Sheets

MAGNETIC SELF-STICK PAD

BACKGROUND OF THE INVENTION

1. Field of the Invention

The present invention relates generally to magnets and, more specifically, to an apparatus providing means for organizing magnetic objects such as paper clips and needles accessible within a workstation area without being within the motor path of the work being performed, such as sewing machine needles being attached to an accessible portion of a sewing machine without being within the normal path of hand movement. The apparatus is comprised of a pliable planar magnetic substance having an adhesive layer whereby the magnetic apparatus can be selectively positioned or repositioned on any vertical, horizontal or curved magnetic and/or non-magnetic surface.

The purpose of the invention is to provide access to small metallic objects without having dedicated containers for said metallic objects such as paper clip containers. Most paper clip containers require some type of ballast to overcome the magnetic force as paper clips are removed from the containers. The present invention is fixedly positioned to an object by adhesive means whereby clips or other small metallic objects can be easily removed using one hand which is not the case with some paper clip containers that require the user to hold onto the container while removing clips.

The present invention provides an additional element in the form of a border projecting upward along the periphery edge of said magnetic apparatus whereby the small metallic objects will be magnetically held angularly to the magnetic planar surface.

Furthermore, the present invention provides an additional attachment element in the form of mating hook and loop material. One mating member of the hook and loop material is bonded to the planar magnetic substance, while the other mating member has an adhesive layer covered by a removable protective element whereby removal of the adhesive protective element provides means for selective attachment to any metallic or non-metallic surface.

In addition, the magnetic apparatus can have indicia imprinted on or attached to the upper planar magnetic surface serving the function of advertisement or may be comprised of a company logo.

2. Description of the Prior Art

There are other magnetic device designed for holding magnetic objects. Typical of these is U.S. Pat. No. 4,427,960 issued to Wuerfel on Jan. 24, 1984.

Another patent was issued to Miller on Oct. 5, 1993 as U.S. Pat. No. 5,249,336. Yet another U.S. Pat. No. 5,548,904 was issued to Rood on Aug. 27, 1996. Another was issued to Stone on Oct. 28, 1997 as U.S. Pat. No. 5,680,709. Another was issued on Nov. 16, 1999 to Johnson as U.S. Pat. No. 5,983,537 and still yet another was issued on Jul. 6, 1999 to Schonberger as U.S. Pat. No. 5,918,400.

U.S. Pat. No. 4,427,960

Inventor: Robert P. Wuerfel

Issued: Jan. 24, 1984

A magnetic holder for paper clips or other small magnetically attractable articles comprises a base magnet with a permanently polarized top face of one magnetic polarity, a non-magnetic guide post extending up from the center of the base magnet, and a floating magnet with a central opening which loosely receives the post and a permanently polarized bottom face of the same magnetic polarity as the top face of the base magnet.

U.S. Pat. No. 4,830,321

Inventor: Kenji Irie

Issued: May 16,1989

A magnetic holder has a movable body made of a material upon which a magnet can function. The movable body is attached at its center to the center of the upper surface of the magnet. The lower surface of the magnet can be attached to any surface upon which a magnet can function. The surface of the movable body which faces the magnet is divided into sections radially centering on the center point of that surface. When the movable body is caused to move so that one of its sections is attached to the magnet by magnetic force the other sections are separated from the upper surface of the magnet. Paper is held to the surface upon which the magnetic holder is placed by the clipping part on the end of the section of the movable body which is attached to the magnet. This magnetic holder allows papers to be held to and removed from the appropriate surface easily and without danger of the magnetic holder being dropped from said surface during operation. Furthermore the requirement of only one relatively week magnet reduces the cost of production of this one-touch magnetic holder.

U.S. Pat. No. 4,964,830

Inventor: Hans Wagner

Issued: Oct. 23, 1990

A magnetic device that may be used for storing and dispensing paper clips, and the like, and which may also be used as an amusement or novelty product. A plastic housing houses a bar magnet with the poles arranged vertically. The bar magnet is positioned near but spaced from the upper surface of the housing by a spacer disc made of magnetizable material. The spacer disc has a central opening, above which opening, on the housing's upper surface, magnetic lines of induction are produced that tend to orient a paper clip, or the like, vertically on end and which also allow for prolonged gyratory motion of the paper clip about the end. A plastic, transparent casing may be provided housing iron powder or tiny magnet bits of different shape, which casing is slidably and rotatably mounted with respect to the upper surface of the housing, so that, as the casing is slid or rotated, different patterns are formed in kaleidoscope-fashion.

U.S. Pat. No. 5,069,339

Inventor: Nick Hsu

Issued: Dec. 3, 1991

A clip container comprising a casing mounted on a base for holding clips. The casing has an annular top edge around the periphery thereof and an inner concave surface portion for holding clips. The concave surface portion has a hollow, conical projection at its center. The base has a raised wall around the periphery and a post at the center respectively for supporting the annular top edge and the hollow, conical projection. Magnetic elements are mounted on the top edge of the raised wall and the hollow, conical projection to attract clips to the annular top edge or the hollow, conical projection for easy grasping.

U.S. Pat. No. 5,249 336

Inventor: Joseph T. Miller

Issued: Oct. 5, 1993

A binder clip includes a clamping element, a pair of opposed gripping means which when compressed open and close the clamping element and sleeves covering the opposed gripping means, the improvement comprising a sleeve of soft pliable plastic having an aperture for inserting over the opposed gripping means and a magnetic component located within at least one of the sleeves, and for use for holding the element to a metallic surface.

U.S. Pat. No. 5,548,904

Inventor: John D. Rood

Issued: Aug. 27, 1996

A catcher for catching items such as pens, coins, lipsticks and crayons which may have inadvertently been left in clothing placed in a clothes dryer. The catcher comprises an elongate tray mountable to the interior surface of the door or other stationary surfaces within the dryer. The tray may be integrally formed as part of the dryer such as on the interior surface of the door or may be detachably secured by brackets, adhesives or magnetic securement devices. The tray may include a removable liner. In an alternate embodiment of the invention, the tray has a funnel-like configuration which communicates with a discharge conduit to transfer items to a receptacle exterior of the drying chamber.

U.S. Pat. No. 5,680,709

Inventor: John W. Stone

Issued: Oct. 28, 1997

A device for properly aligning and registering a display panel onto an adhesive backing panel to create a display article is provided, as well as a method and kit for such registration. The alignment device comprises a base having two wall portions which define an area within the base that is geometrically congruent to the display and backing panels. The wall portions are skewed with respect to one another, defining limit stops against which the display and backing panels can be placed to inhibit their movement and enable proper registration. The alignment device is preferably made out of a unitary construction of plastic, with the base having an arcuate cut-out along its perimeter. A method for registering the display panel on the backing to create a display article provides for proper placement of the panels into the alignment device. A kit includes a plurality of backing panels with adhesive layers, and an alignment device. Backing panels may include a removable protective sheet on the adhesive layer and a magnetic strip.

U.S. Pat. No. 5,983,537

Inventor: Keith D. Johnson

Issued: Nov. 16, 1999

A novel card device which may be supported on a refrigerator or other metallic objects by magnetic coupling thereto. The card device is preferably made in the form of a mailable postcard or otherwise a greeting card or an announcement card. In the case of an announcement card and postcard, a single substrate is employed and a magnetic film is adhesively secured to an upper face of the substrate. A second substrate or otherwise a portion of the first substrate may be folded over and placed facewise upon the second substrate and adhesively secured thereto. The magnetic film is thereby captured between the two plies. In the preparation of a greeting card, a substrate may be folded into three different panels with one panel being folded over the next adjacent panel and attached thereto with a magnetic film secured therebetween, again usually by adhesives. A message may be then presented on any of the exposed faces of the panels. In addition, individual strips of the magnetic film may be employed.

U.S. Pat. No. 5,918,400

Inventor: Milton Schonberger

Issued: Jul. 6, 1999

A kit and a method of use of the kit for applying a full magnet backing to a photograph. The kit includes a mask with a first side with a cutout through it and a second side with either a cutout through it or an applied border outline on a then transparent second side. The border of the cutout in the second side or the applied on border of the second side overlying the border outline of the cutout in the first side. A magnet card of the size and shape of the cutout in the first side has adhesive on one surface thereof and is applied to the rear of the photograph held between the sides of the mask. The photograph is then trimmed to the edges of the magnet card.

While these magnetic devices may be suitable for the purposes for which they were designed, they would not be as suitable for the purposes of the present invention, as hereinafter described.

SUMMARY OF THE PRESENT INVENTION

The present invention discloses an apparatus providing means for organizing magnetic objects such as paper clips and needles accessible within a workstation area without being within the motor path of the work being performed, such as sewing machine needles being attached to an accessible portion of a sewing machine without being within the normal path of hand movement. The apparatus is comprised of a pliable planar magnetic layer having a top and bottom adhesive layers whereby the magnetic apparatus can be selectively positioned or repositioned on any vertical, horizontal or curved magnetic and/or non-magnetic surface. A protective element covers the bottom adhesive layer and a top layer may be provided having an indicia thereon, such as the company logo. A raised border may also be provided around the periphery of the apparatus.

A primary object of the present invention is to provide a relocatable magnetic apparatus for holding small metal objects.

Another object of the present invention is to provide a magnetic apparatus comprising a substantially pliable planar magnetic substance.

Yet another object of the present invention is to provide a magnetic apparatus having means for attaching said magnetic apparatus to any horizontal, vertical, or curved magnetic or non-magnetic surface.

Still yet another object of the present invention is to provide a magnetic apparatus having an adhesive layer for selectively positioning said magnetic apparatus to a metallic or non-metallic surface.

Another object of the present invention is to provide a magnetic apparatus having an additional element in the form of a protruding border positioned along the periphery of the planar magnetic substance.

Yet another object of the present invention is to provide a magnetic apparatus having an additional element in the form of mating hook and loop material as means of attachment wherein one member of hook and loop material is bonded to the planar magnetic substance and the mating member has an adhesive layer for attachment to a predetermined metallic or non-metallic surface.

Still yet another object of the present invention is to provide a magnetic apparatus having indicia imprinted on or attached to the upper planar magnetic surface that may serve as an advertisement or comprised of a company logo.

Additional objects of the present invention will appear as the description proceeds.

The present invention overcomes the shortcomings of the prior art by providing a magnetic apparatus providing means for organizing magnetic objects such as paper clips and needles accessible within a workstation area. The magnetic apparatus is comprised of a pliable planar magnetic substance having means for selectively attaching said magnetic apparatus to any vertical, horizontal or curved magnetic and/or non-magnetic surface.

An additional element in the form of a border projecting upward along the periphery edge of said magnetic apparatus whereby the small metallic objects will be magnetically held angularly to the magnetic planar surface.

Furthermore, the present invention provides an additional attachment element in the form of mating hook and loop material. One mating member of the hook and loop material is bonded to the planar magnetic substance, while the other mating member has an adhesive layer covered by a removable protective element whereby removal of the adhesive protective element provides means for selective attachment to any metallic or non-metallic surface.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

Furthermore, the attached pins or needles can be easily positioned and removed from the magnetic apparatus using one hand because the magnetic apparatus is fixedly positioned to a substantial structure.

Figure 5:
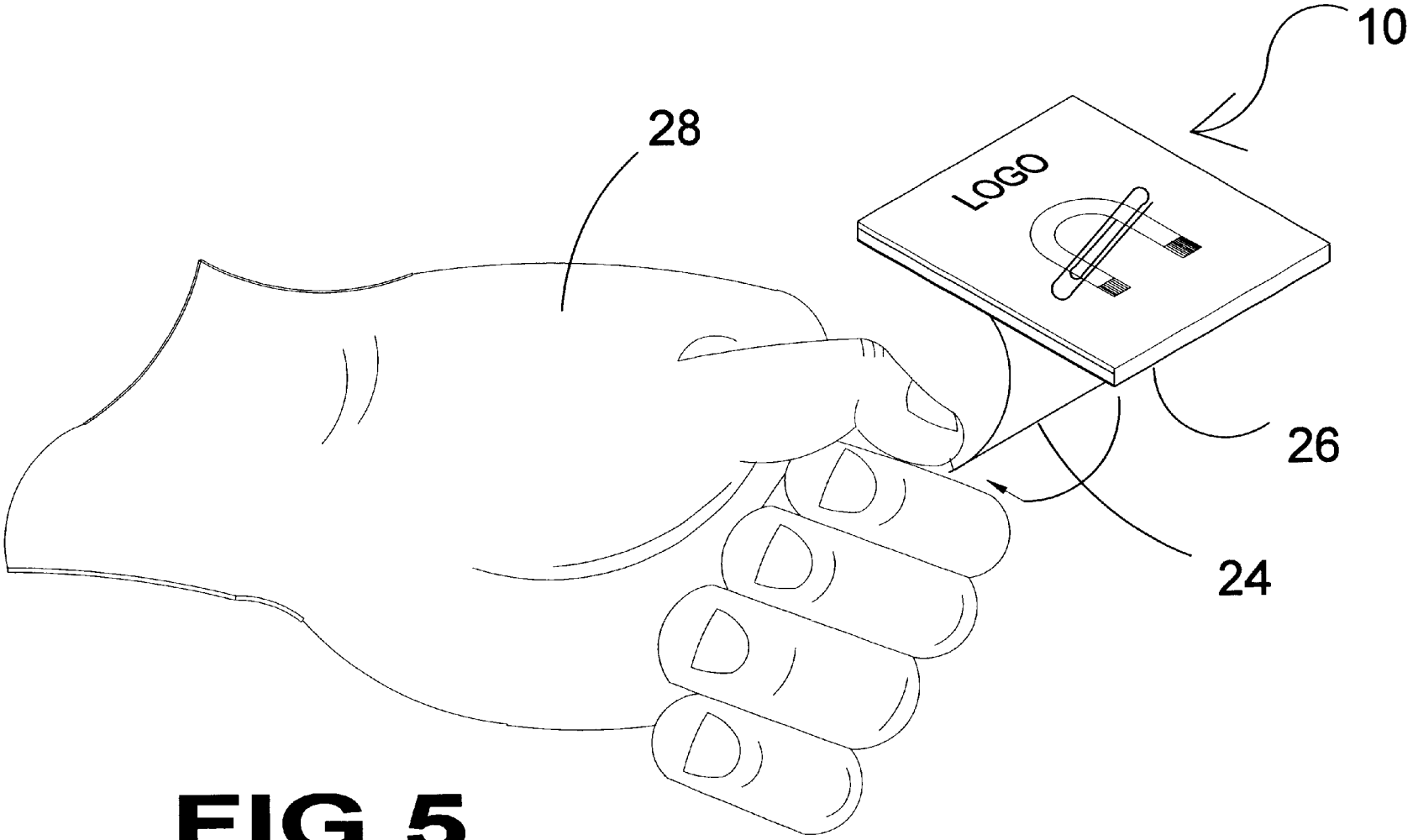

FIG. 5 is a perspective view of the present invention showing the removal of the adhesive layer protective element whereby the magnetic apparatus can be selectively positioned to any surface.

Figure 6:
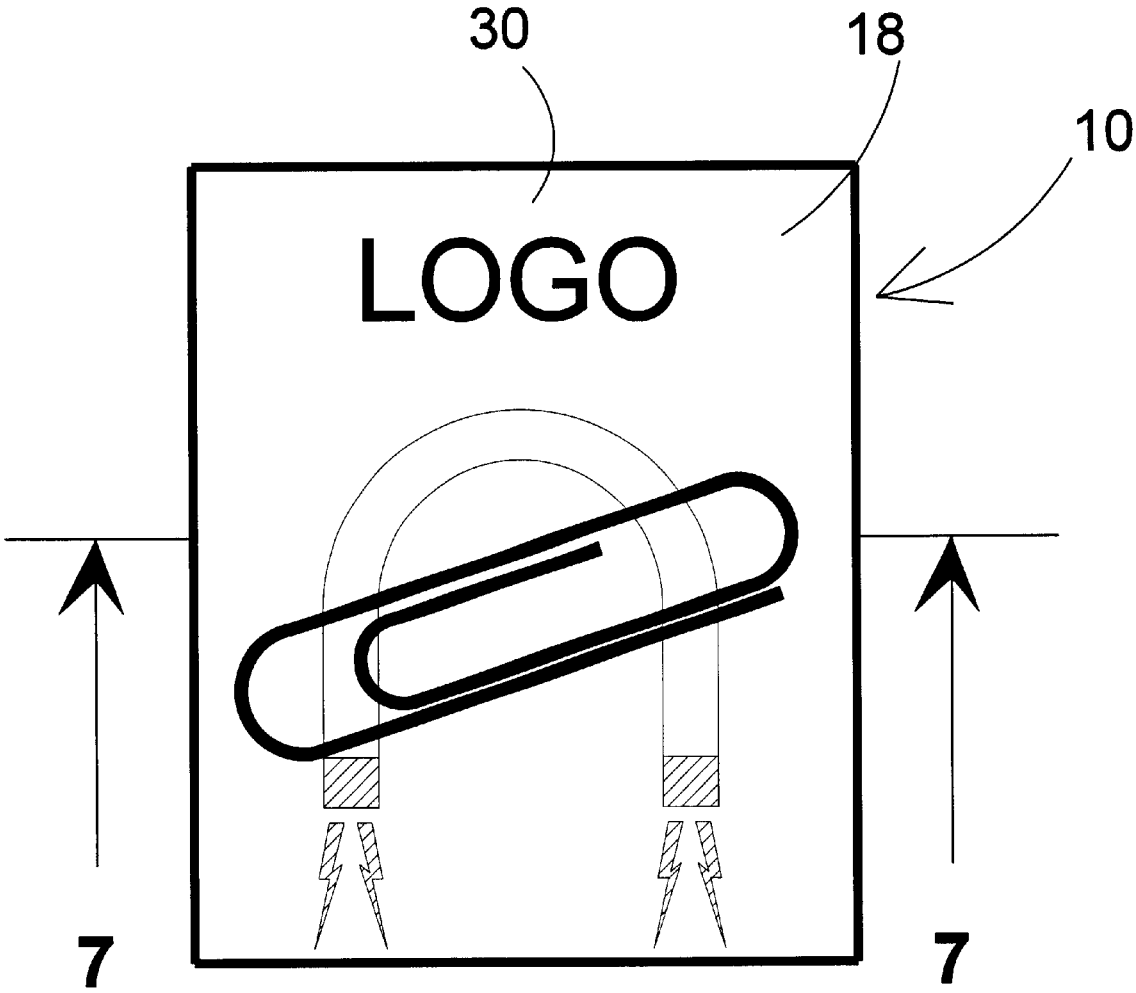
Figure 7:
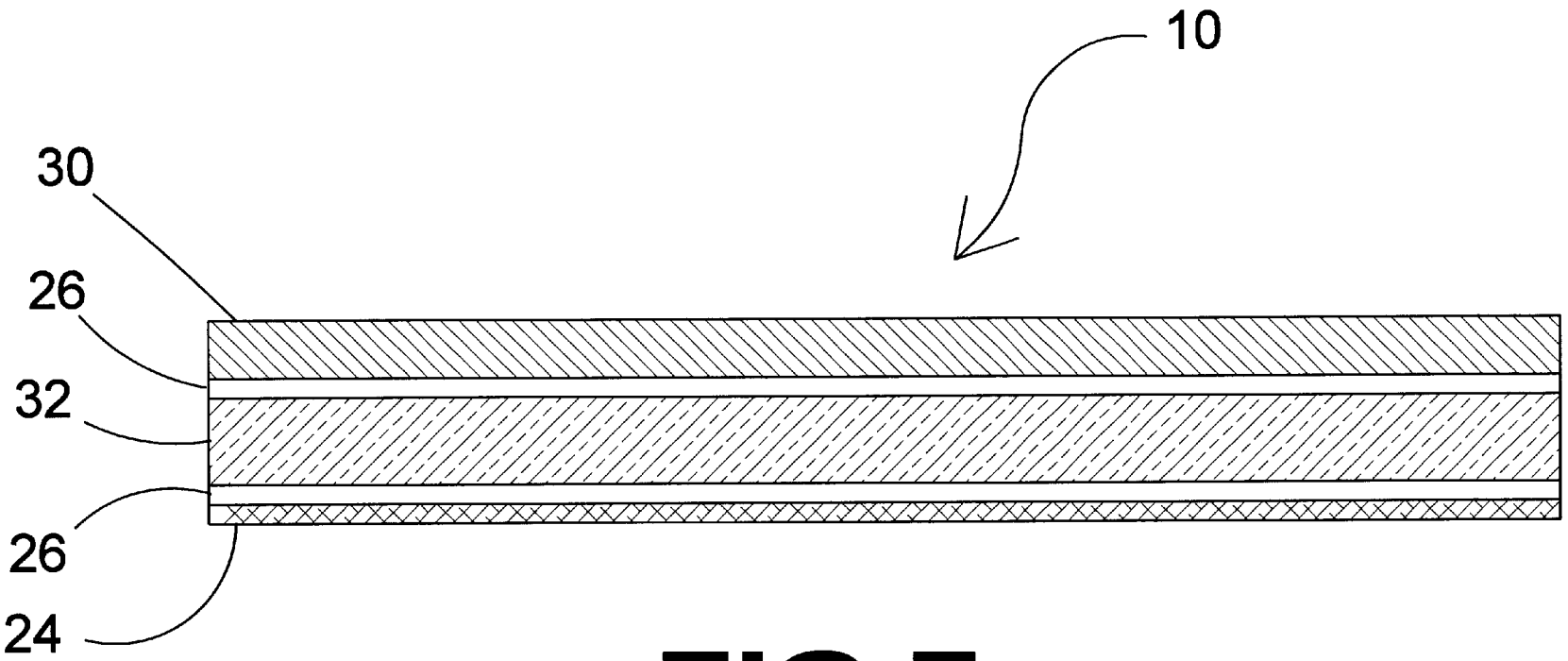

FIG. 6 is a front view of the present invention. Shown is the magnetic apparatus having a top layer consisting of a durable material protecting the pliable magnetic material from abrasion. The top layer can be imprinted with any graphic element serving the function of advertising or have a company logo thereon;

FIG. 7 is a cross sectional view of the present invention taken from FIG. 6 as indicated. Shown is a magnetic substance having a top side and a bottom side. The top side has a layer of an appropriate bonding agent holding a graphics layer thereto. The bottom side of the magnetic substance has a bonding agent affixed thereto having a peelably removable protective element.

Figure 8:
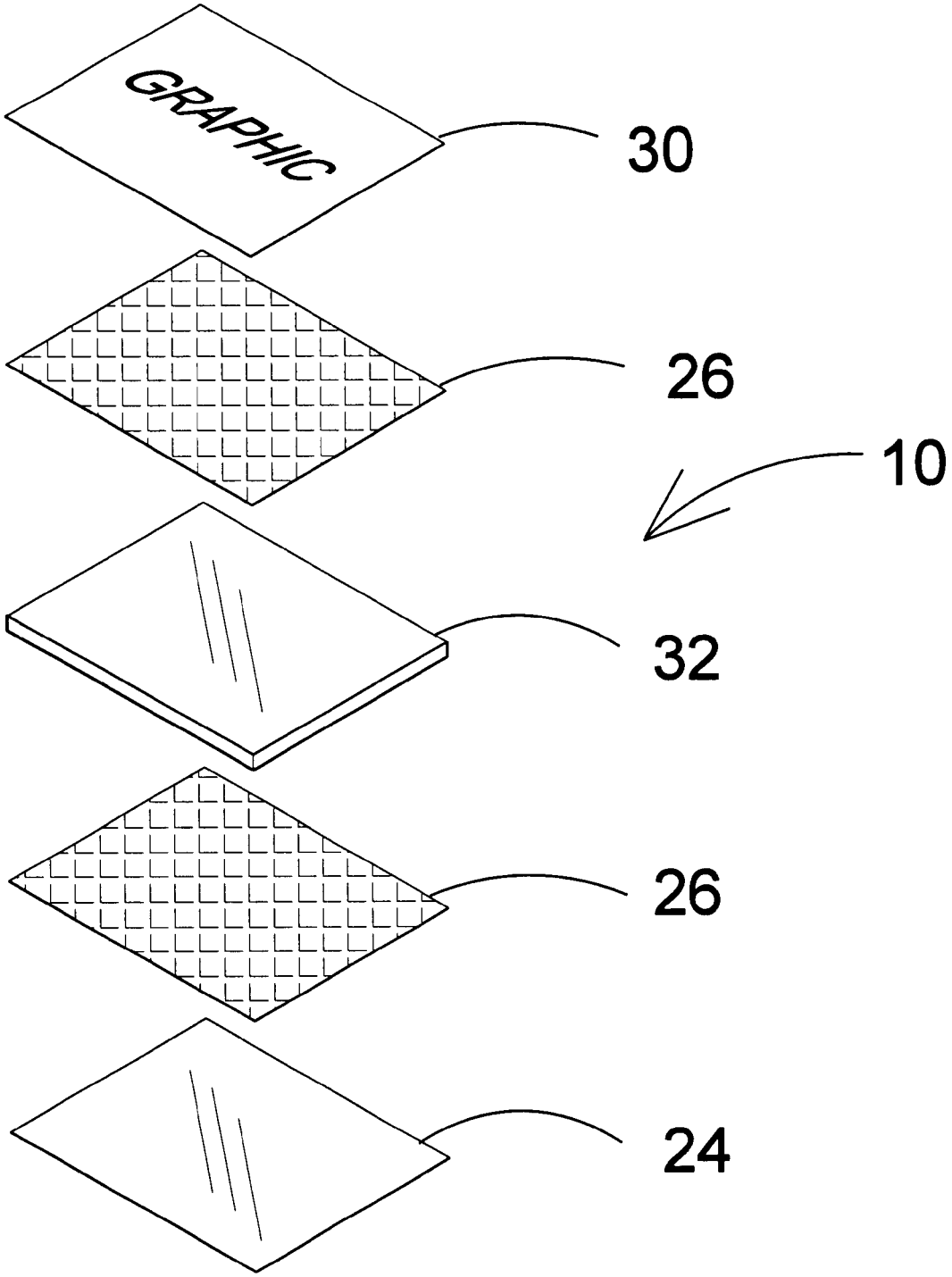

FIG. 8 is an exploded view of the present invention. Shown is a pliable planar magnetic substance having a top side and a bottom side. The top side has a protective layer that is bonded to the magnetic substance by any means known within the art, such as adhesively. The bottom side of the magnetic substance has a bonding agent affixed thereto having a removable protective element. Upon removal of the protective element the magnetic apparatus can be selectively positioned by means of the bonding agent to any horizontal, vertical or curved surface of any metallic or non-metallic surface.

Figure 9:
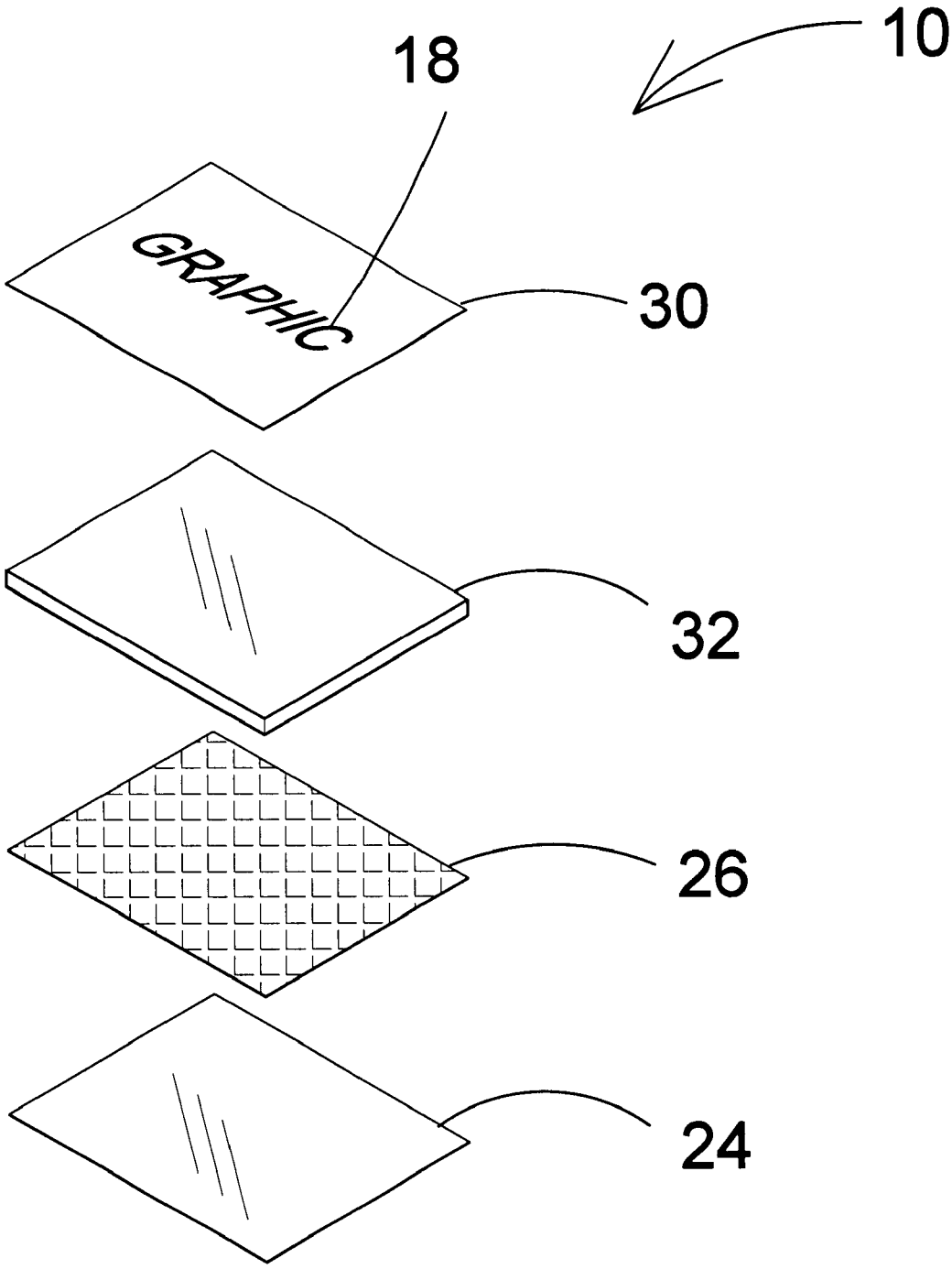

FIG. 9 is an exploded view showing an additional element of the present invention. Shown is a pliable planar magnetic substance having a top side and a bottom side. The top side has a protective layer that can be embossed or imprinted with indicia. The bottom side of the magnetic substance has a bonding agent affixed thereto having a removable protective element. Upon removal of the protective element the magnetic apparatus can be selectively positioned by means of the bonding agent to any horizontal, vertical or curved surface of any metallic or non-metallic surface.

Figure 10:
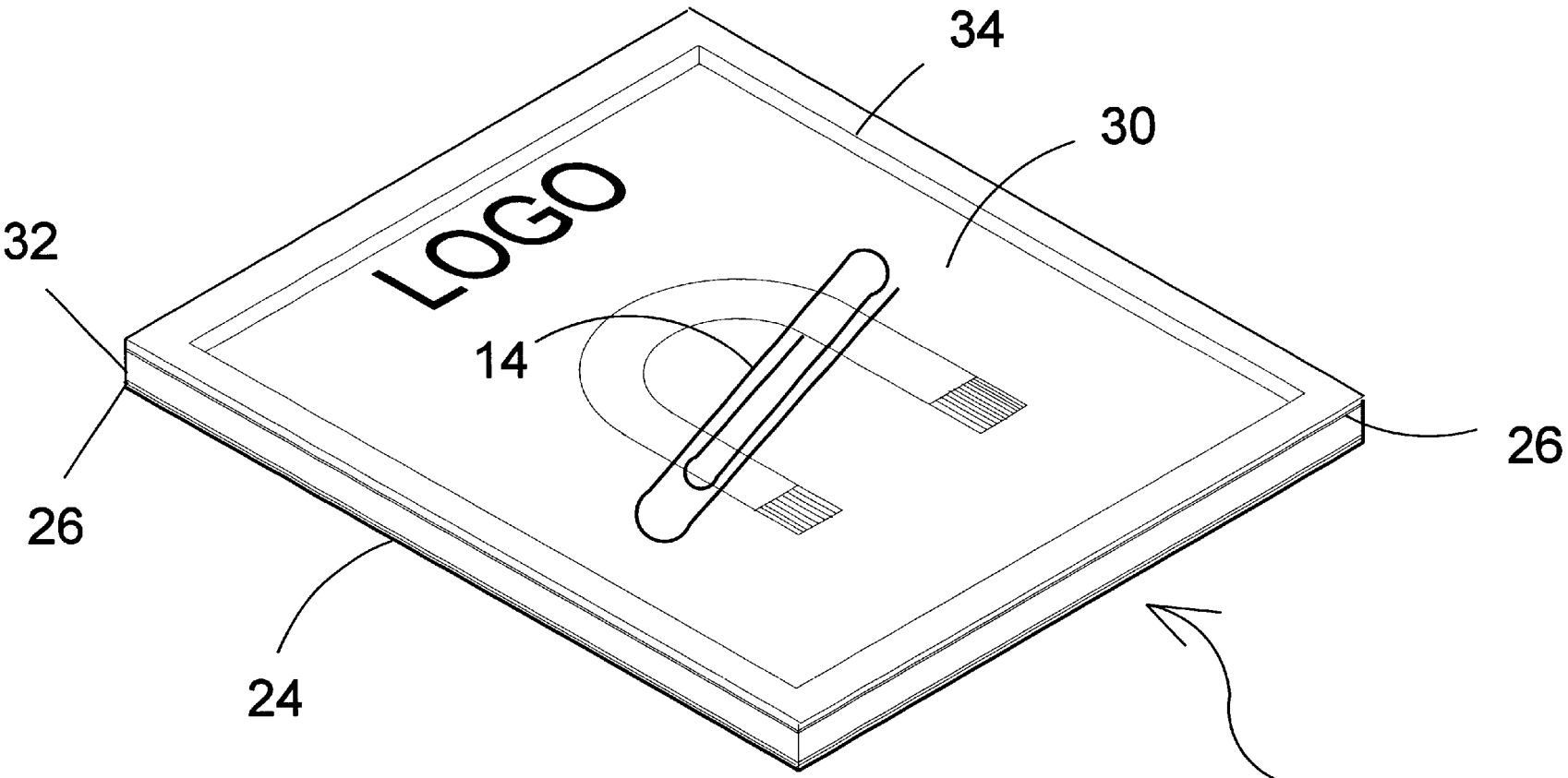

FIG. 10 is a perspective view of the present invention showing an additional element in the form of a protruding border formed along the periphery of the planar magnetic substance. The border causes any attached metal objects engaging the border to rest angularly to the planar magnetic substance.

Figure 11:
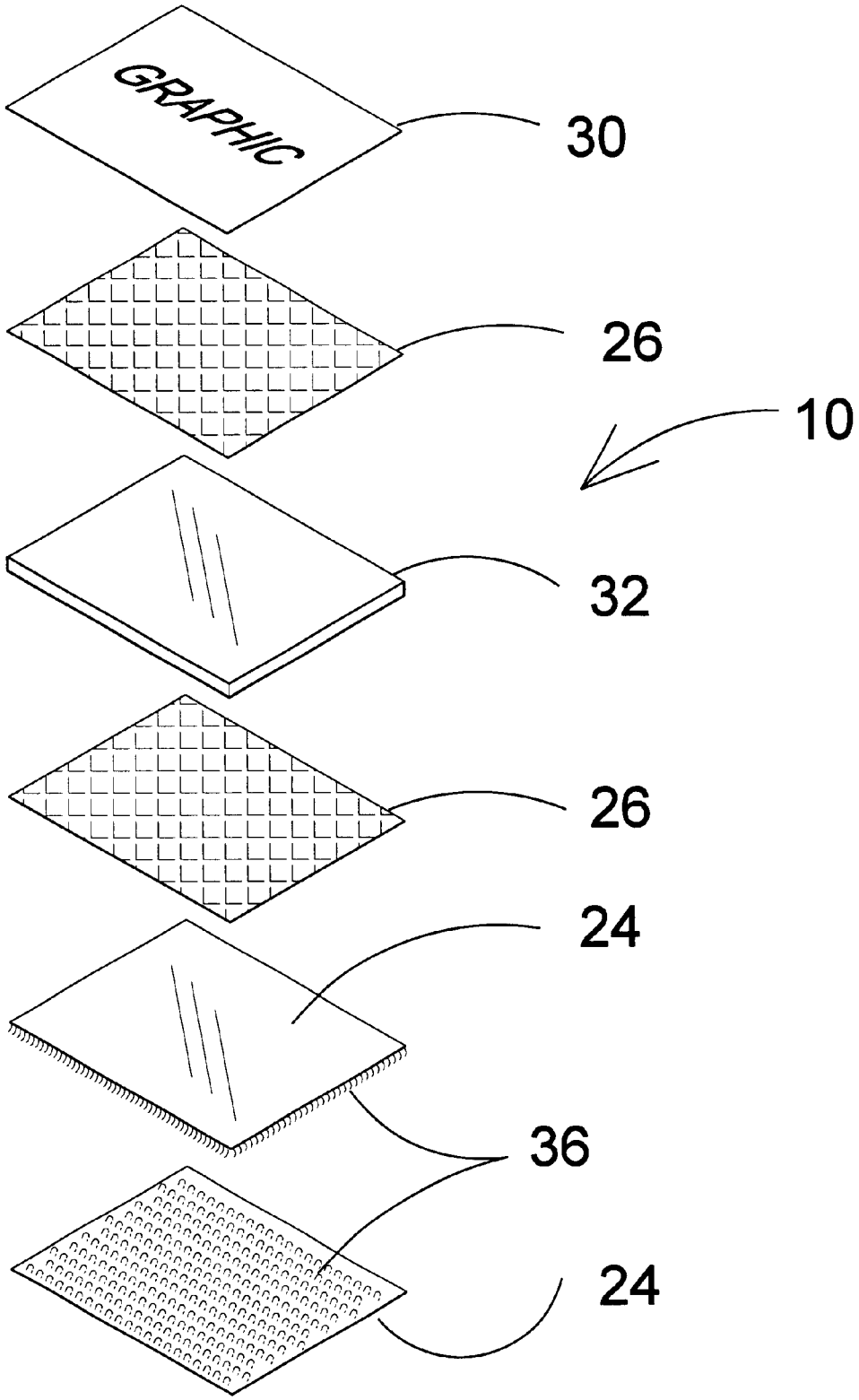

FIG. 11 is an exploded view showing an additional element of the present invention. Shown is a pliable planar magnetic substance having a top side and a bottom side. The top side has a protective layer that is bonded to the magnetic substance by any means known within the art, such as adhesively. The bottom side has mating members of hook and loop material.

Figure 12:
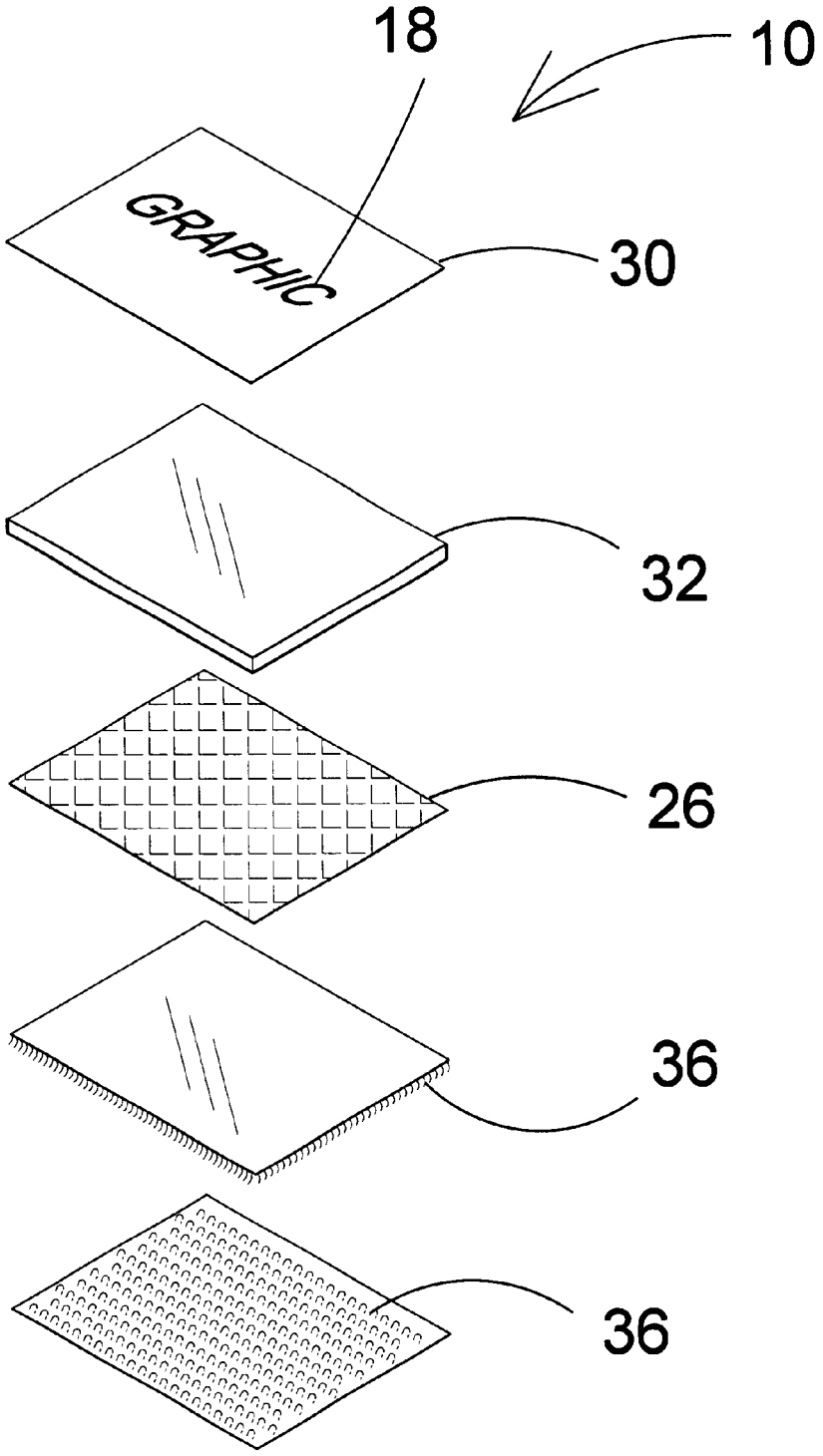

FIG. 12 is an exploded view showing an additional element of the present invention. Shown is a pliable planar magnetic substance having a top side and a bottom side. The top side has a protective layer that can be embossed or imprinted with indicia. The bottom side has mating members of hook and loop material.

LIST OF REFERENCE NUMERALS

With regard to reference numerals used, the following numbering is used throughout the drawings.

10 present invention
12 surface
14 paper clip or other magnetically-attractive device
16 user
18 indicia
20 copier
22 sewing machine
24 removable protective element
26 adhesive layer
28 hand
30 top graphics layer
32 magnetic layer
34 border
36 hook and loop

DESCRIPTION OF THE PREFERRED EMBODIMENT(S)

In order that the invention may be more fully understood, it will now be described, by way of example, with reference to the accompanying drawings in which FIGS. 1 through 10 illustrate the present invention being a magnetic self-stick pad.

Figure 1:
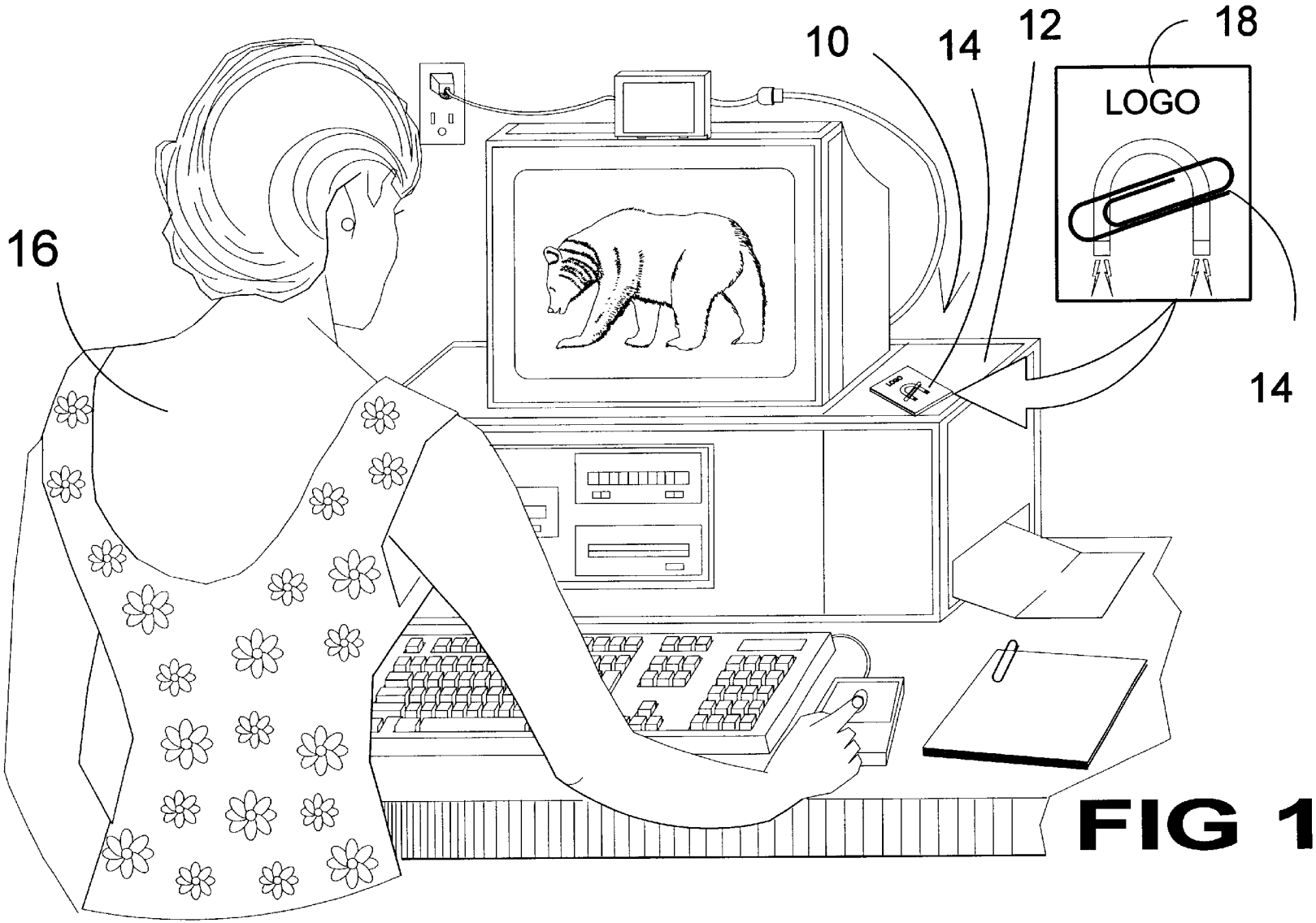
FIG. 1 is an illustrative view of the present invention in use, shown is the magnetic apparatus fixedly positioned to a surface providing means for holding paper clips. The magnetic apparatus provides organizational capabilities to otherwise unused surfaces. It also eliminates the need for a separate specialized container that takes up workstation real estate. The magnetic apparatus having an adhesive layer can be located or relocated to suit the user's needs.

Turning to FIG. 1, shown therein is an illustrative view of the present invention 10 in use. Shown is the magnetic apparatus 10 fixedly positioned to a surface 12 providing means for holding paper clip or other magnetically-attractive device 14. The magnetic apparatus 10 provides organizational capabilities to otherwise unused surfaces. It also eliminates the need for a separate specialized container that takes up workstation real estate. The magnetic apparatus 10 has an adhesive layer and can be located or relocated to suit the user's 16 needs and also can have indicia 18 imprinted thereon.

Figure 2:
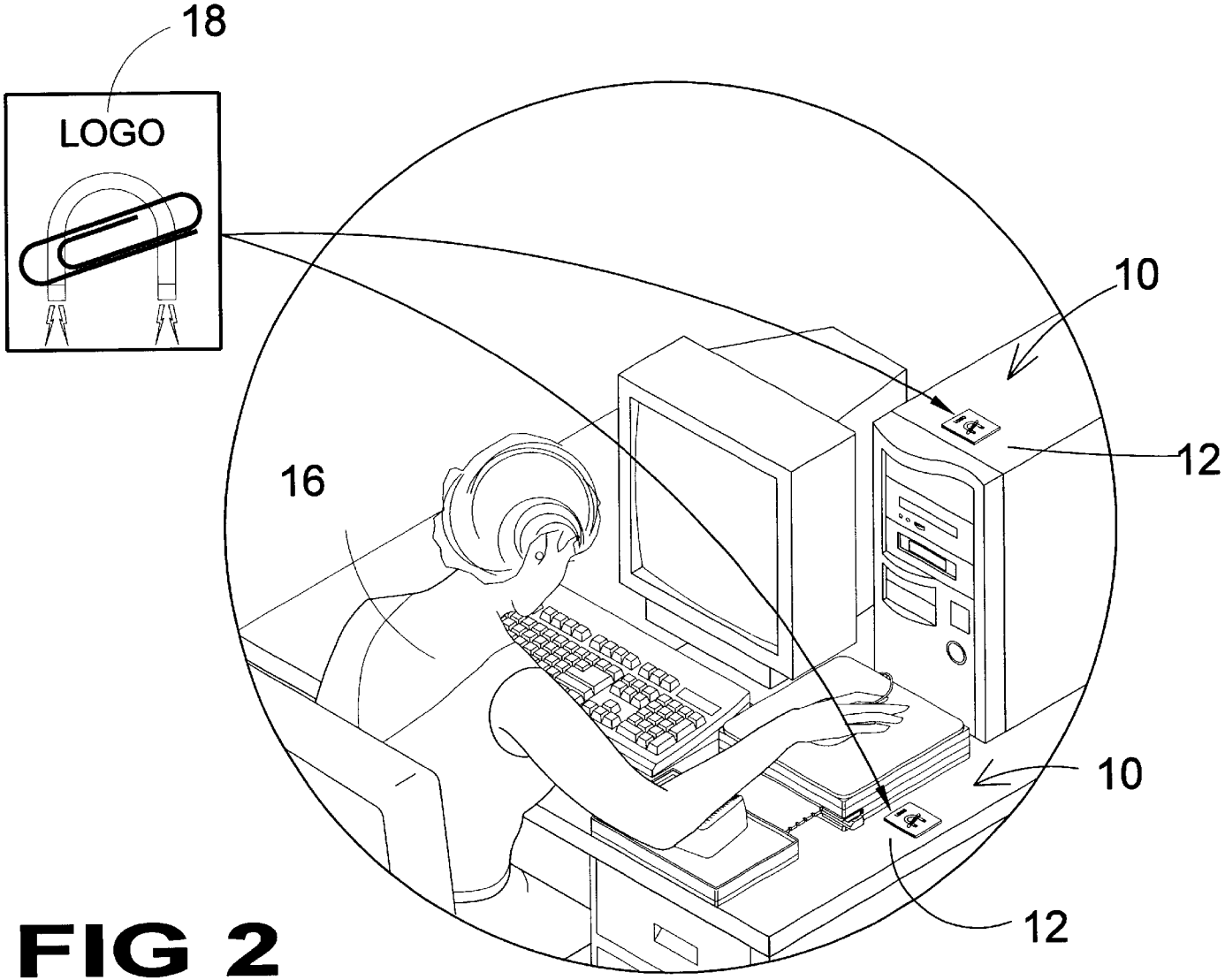
FIG. 2 is an illustrative view of the present invention showing various positions for the magnetic apparatus. The magnetic apparatus can be selectively positioned or repositioned to suit the user's needs and can be attached to any vertical, horizontal or curved surface. The magnetic apparatus is comprised of a planar magnetic substance having an adhesive layer providing means for attachment to any surface. In addition, the magnetic apparatus has indicia imprinted thereon that can serve the function of advertising or can display a company logo.

Turning to FIG. 2, shown therein is an illustrative view of the present invention 10 showing various positions for the magnetic apparatus. The magnetic apparatus 10 can be selectively positioned or repositioned to suit the user's 16 needs and can be attached to any vertical, horizontal or curved surface 12. The magnetic apparatus is comprised of a planar magnetic substance having an adhesive layer providing means for attachment to any surface. In addition, the magnetic apparatus has indicia 18 imprinted thereon that can serve the function of advertising or can display a company logo.

Figure 3:
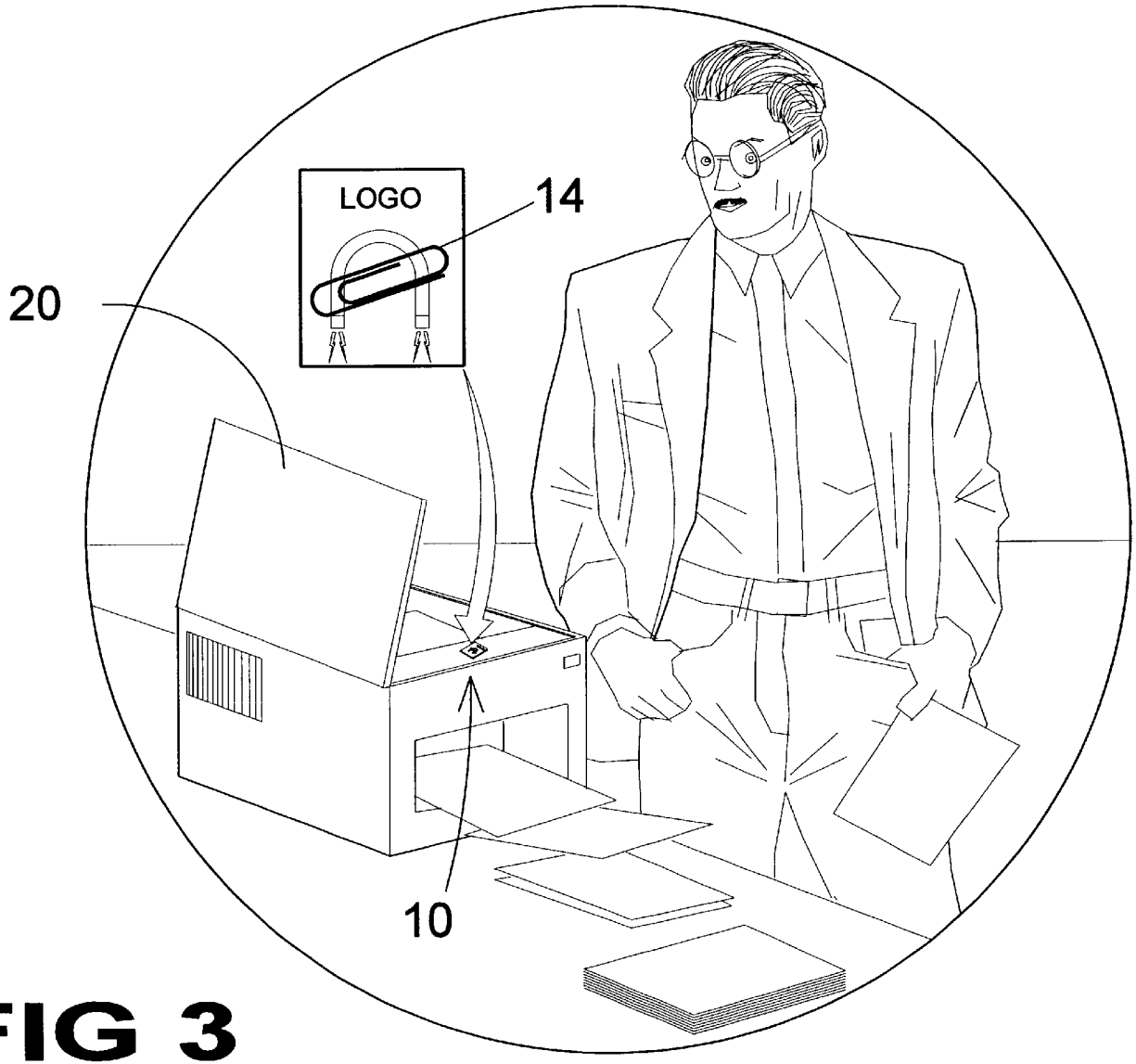
FIG. 3 is an illustration of the present invention. Shown is another use of the magnetic apparatus. The apparatus being attached to a copier provides means for holding paper fasteners while copies are being made. It also provides storage for discarded staples that can damage machinery and equipment.

Turning to FIG. 3, shown therein is an illustration of the present invention 10. Shown is another use of the magnetic apparatus of the present invention. The apparatus, being attached to a copier 20, provides means for holding paper fasteners 14 while copies are being made. It also provides storage for discarded staples that can damage machinery and equipment.

Figure 4:
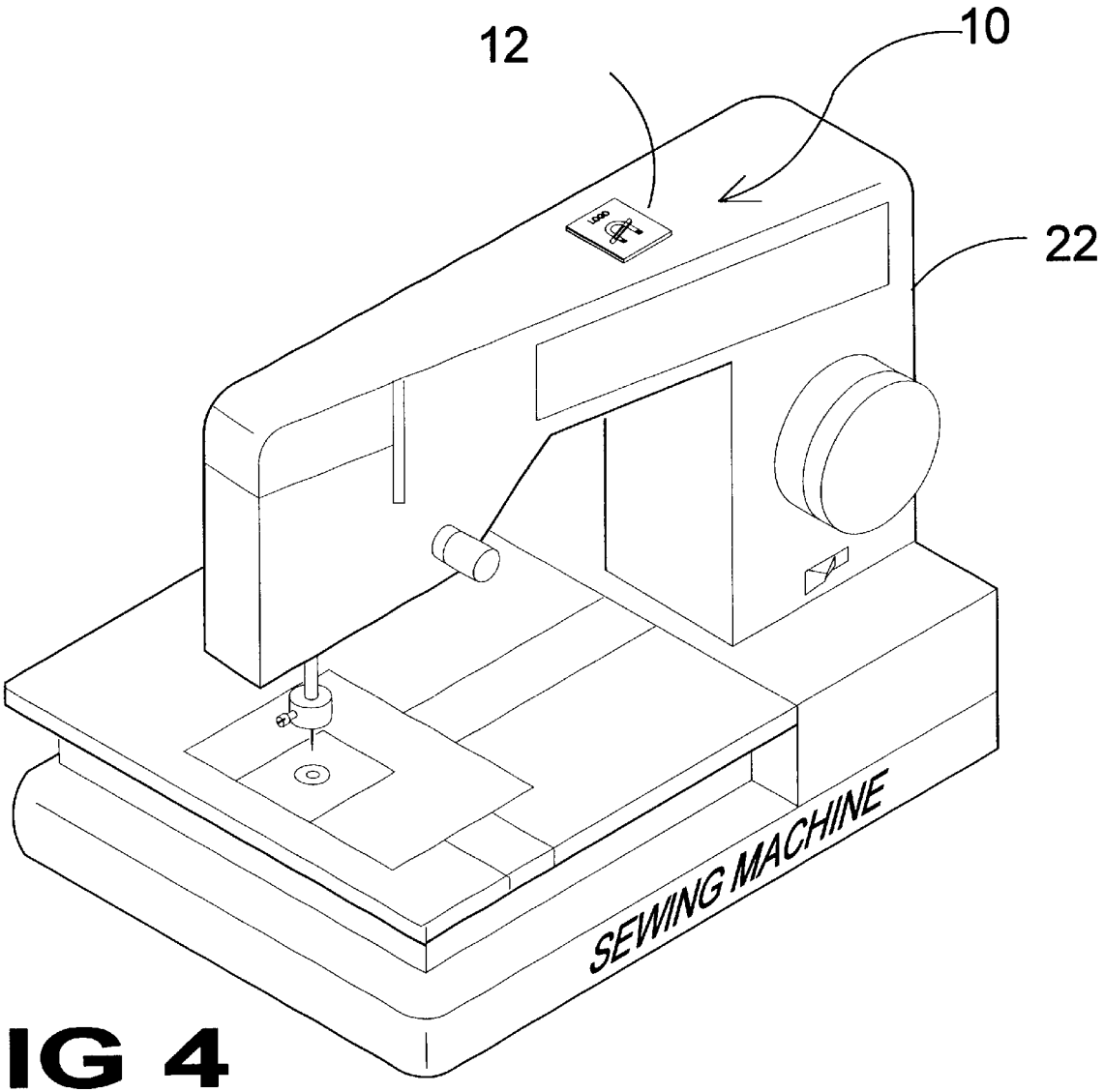
FIG. 4 is an illustration of the present invention. Shown is another use of the magnetic apparatus. The apparatus being attached to a sewing machine provides means for holding pins or needles which are easily accessible to the user within the workstation.

Turning to FIG. 4, shown therein is an illustration of the present invention 10. Shown is another use of the magnetic apparatus. The apparatus 10 being attached to a sewing machine 22 provides means for holding pins or needles which are easily accessible to the user within the workstation. Furthermore, the attached pins or needles can be easily positioned and removed from the magnetic apparatus using one hand because the magnetic apparatus is fixedly positioned to a substantial structure 12.

Turning to FIG. 5, shown therein is a perspective view of the present invention 10 showing the removal by the hand 28 of the user of the protective element 24, e.g., paper, exposing adhesive layer 26, whereby the magnetic apparatus can be selectively positioned to any surface.

Turning to FIG. 6, shown therein is a front view of the present invention 10. Shown is the magnetic apparatus having a top layer 30 consisting of a durable material protecting the pliable magnetic material from abrasion. The top layer 30 can be imprinted with any graphic element 18 serving the function of advertising or have a company logo thereon.

Turning to FIG. 7, shown therein is a cross sectional view of the present invention 10 taken from FIG. 6 as indicated. Shown is a flexible magnetic layer 32 having or being bonded to an adhesive layer 26 and an adhesive bottom side 26. The top adhesive side 26 has a layer of an appropriate bonding agent holding a graphics layer 30 thereto. The bottom side of the magnetic substance has a bonding or agent or adhesive layer 26 affixed thereto having a peelably removable protective element 24, e.g., paper.

Turning to FIG. 8, shown therein is an exploded view of the present invention 10. Shown is a pliable planar magnetic substance layer 32 having or being bonded to an adhesive layer 26 and a bottom side adhesive layer 26. The top side of the magnetic layer 32 has a graphic surface 30 bonded thereto by any means 26 known within the art, such as adhesively. The bottom side of the magnetic layer has a bonding agent affixed thereto having a removable protective element 24, e.g., paper. Upon removal of the protective element 24 the magnetic apparatus can be selectively positioned by means of the bonding agent 26 to any horizontal, vertical or curved surface of any metallic or non-metallic surface 12 (not shown) by use of adhesive layer 26.

Turning to FIG. 9, shown therein is an exploded view showing an additional element of the present invention 10. Shown is a pliable planar magnetic substance layer 32 having a top side and a bottom side. The top side has a protective layer 30 that can be embossed or imprinted with indicia 18. The bottom side of the magnetic substance has a bonding agent 26 affixed thereto having a removable protective element 24. Upon removal of the protective element 24 the magnetic apparatus can be selectively positioned by means of the bonding agent 26 to any horizontal, vertical or curved surface of any metallic or non-metallic surface.

Turning to FIG. 10, shown therein is a perspective view of the present invention 10 showing an additional element in the form of a raised protruding border 34 formed along the periphery of the present invention 10. The border 34 causes any attached metal objects 14 engaging the border to rest angularly to the planar magnetic substance. Other elements previously discussed are also shown.

Turning to FIG. 11, shown therein is an exploded view of the present invention 10. Shown is a pliable planar magnetic substance layer 32 having or being bonded to an adhesive layer 26 and a bottom side mating hook and loop material 36. The top side of the magnetic layer 32 has a graphic surface 30 bonded thereto by any means 26 known within the art, such as adhesively. The bottom side of the magnetic layer has a bonding agent affixed to one element of mating hook and loop material 36 that can be affixed to a surface and a mating hook and loop material affixed to the magnetic apparatus. Whereby the magnetic apparatus can be selectively positioned by means of the mating hook and loop material 36 to any horizontal, vertical or curved surface of any metallic or non-metallic surface 12 (not shown).

Turning to FIG. 12, shown therein is an exploded view showing an additional element of the present invention 10. Shown is a pliable planar magnetic substance layer 32 having a top side and a bottom side. The top side has a protective layer 30 that can be embossed or imprinted with indicia 18. The bottom side of the magnetic substance has mating elements of hook and loop material 36. One element of hook and loop material has a bonding agent 26 affixed thereto having a removable protective element 24. Upon removal of the protective element 24 the magnetic apparatus can be selectively positioned by means of the bonding agent 26 to any horizontal, vertical or curved surface of any metallic or non-metallic surface. The other element of hook and loop material 36 is fixedly attached to the magnetic apparatus. Whereby said magnetic apparatus can be selectively positioned to the surface mounted hook and loop material 36.

What is claimed to be new and desired to be protected by Letters Patent is set forth in the appended claims.

I claim:

1. An apparatus for holding small objects of material attracted to a magnet consisting of:

a) a generally planar magnetic member which is sufficiently flexible to conform to curved surfaces, said magnetic member having a top side and a bottom side;

b) a first adhesive layer disposed on said top side of said magnetic member;

c) a second adhesive layer disposed on said bottom side of said magnetic member;

d) a graphic layer for display disposed on said first adhesive layer on said top side of said magnetic member;

e) a peel off protective layer disposed on said second adhesive layer on said bottom side of said magnetic member; and f) said magnetic member having a raised border on said top side completely surrounding said graphic display.

2. An apparatus for holding small objects of material attracted to a magnet consisting of:

a) a generally planar magnetic member which is sufficiently flexible to conform to curved surfaces, said magnetic member having a top side and a bottom side;

b) a first adhesive layer disposed on said top side of said magnetic member;

c) a second adhesive layer disposed on said bottom side of said magnetic member;

d) a graphic layer for display disposed on said first adhesive layer on said top side of said magnetic member;

e) a first mating hook or loop material layer disposed on said first adhesive layer on said bottom side of said magnetic member;

f) a second mating hook or loop material layer disposed on a surface to which the apparatus is attached, said second mating hook or loop material for receiving said first mating hook or loop material whereby the apparatus is attached to the surface; and g) said magnetic member having a raised border on said top side completely surrounding said graphic display.

3. The method of organizing metallic paper clips and needles in a work area in a readily accessible manner without interfering with work movements, said method consisting of the steps of:

a) mounting on a first side of a flexible, generally planar sheet of magnet material a layer of attaching material protected by a peel off cover said sheet having a raised border;

b) mounting on an second side of said magnet material a layer of material having a graphic design for display using an adhesive to secure said layer of material having a graphical design to said sheet of magnet material;

c) peeling off said peel off cover from the first side of said sheet of magnet material;

d) sticking said sheet of magnetic material to a surface which is conveniently located within reach without interfering with any work movements with said graphic design being displayed said graphic being entirely within said raised border; and e) placing either or both of paper clips and needles on said graphic design for magnetic storage.

4. The method of claim 3 in which said attaching material and peel off cover consist of mating hook and loop sheets, the peel off cover having an adhesive for attachment to said surface.

* * * * *